US009696649B2

(12) United States Patent
Kaneto

(10) Patent No.: US 9,696,649 B2
(45) Date of Patent: Jul. 4, 2017

(54) OPTICAL HEAD, OPTICAL PRINT HEAD, IMAGE FORMATION APPARATUS, AND IMAGE READER

(71) Applicant: Oki Data Corporation, Tokyo (JP)

(72) Inventor: Taishi Kaneto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/071,349

(22) Filed: Mar. 16, 2016

(65) Prior Publication Data

US 2016/0313664 A1 Oct. 27, 2016

(30) Foreign Application Priority Data

Apr. 27, 2015 (JP) ..... 2015-090128

(51) Int. Cl.
*G03G 15/04* (2006.01)
*G03G 15/043* (2006.01)
*G03G 21/20* (2006.01)

(52) U.S. Cl.
CPC ... *G03G 15/04036* (2013.01); *G03G 15/0435* (2013.01); *G03G 21/20* (2013.01)

(58) Field of Classification Search
CPC ..... G03G 15/32
See application file for complete search history.

(56) References Cited

U.S. PATENT DOCUMENTS

2005/0130045 A1* 6/2005 Ozawa ..... G03F 7/70466 430/5
2007/0070449 A1* 3/2007 Poletto ..... G03G 15/238 358/498
2009/0028592 A1* 1/2009 Nakajima ..... G03G 15/326 399/52
2016/0037023 A1* 2/2016 Chen ..... H04N 5/2258 348/175

FOREIGN PATENT DOCUMENTS

JP 2001133659 A * 5/2001
JP 2011-034673 A 2/2011

OTHER PUBLICATIONS

JP_2001133659_A_T Machine Translation, Japan, 2001, Nishimura et al.*
Effects-of-moisture absorption, 2014.*

* cited by examiner

*Primary Examiner* — Clayton E Laballe
*Assistant Examiner* — Victor Verbitsky
(74) *Attorney, Agent, or Firm* — Mots Law, PLLC

(57) ABSTRACT

An optical head includes a lens array including resin lenses, a holder that holds the lens array, and a positioning mechanism that positions the holder such that the holder is opposed to a target. The positioning mechanism is configured to change a distance between the lens array and the target depending on a change in at least any one of temperature and humidity.

17 Claims, 11 Drawing Sheets

OPTICAL HEAD, OPTICAL PRINT HEAD, IMAGE FORMATION APPARATUS, AND IMAGE READER

CROSS REFERENCE TO RELATED APPLICATIONS

This application claims priority based on 35 USC 119 from prior Japanese Patent Application No. 2015-090128 filed on Apr. 27, 2015, entitled "OPTICAL HEAD, OPTICAL PRINT HEAD, IMAGE FORMATION APPARATUS, AND IMAGE READER", the entire contents of which are incorporated herein by reference

BACKGROUND OF THE INVENTION

1. Field of the Invention

This disclosure relates to an optical head, an optical print head, an image formation apparatus, and an image reader each including a lens array.

2. Description of Related Art

Materials for lenses include an optical glass and a resin. The optical glass has a high weather resistance and excellent mechanical characteristics, but requires more complicated manufacturing processes and at a higher cost than the resin lens. Accordingly, the resin lens which is easier to process at a lower cost is preferred to be used depending on the usage purposes.

However, the dimensions of the resin lens easily change depending on a change in the environment conditions (such as temperature and humidity), and the refractive index distribution in the lens tends to change. Accordingly, an image plane distance is changed due to a change in the environment conditions to easily cause a deterioration in the optical performance, such as causing a defocus. There is a possibility that the use of such lenses in an optical print head of an image formation apparatus may cause a deterioration in the printing quality.

For example, in the field of optical pickup apparatuses, a technique has been proposed of providing a correction lens movable in an optical axis direction in order to suppress deterioration in the optical performance of lenses (for example, see Patent Literature 1).

[Patent Literature 1] Japanese Patent Application Publication No. 2011-034673 (see FIG. 1, paragraphs 0156 to 0158).

SUMMARY OF THE INVENTION

However, use of the correction lens as described above poses a problem in that, since the apparatus includes a larger number of lenses in total and needs to be provided with a mechanism to move the lenses, the apparatus inevitably increases in size and becomes more complicated.

An object of an embodiment of the invention is to suppress deterioration in the optical performance due to a change in the environment conditions without causing the apparatus to increase in size and become complicated.

An aspect of the invention is an optical head that includes: a lens array that includes lenses made of a resin; a holder that holds the lens array; and a positioning mechanism that positions the holder such that the holder is opposed to a target. The positioning mechanism is configured to change the distance between the lens array and the target depending on a change in at least any one of temperature and humidity.

According to the aspect of the invention, the distance between the lens array and the target is changed depending on the environment condition (at least either one of the temperature and the humidity). With this configuration, for example, the distance between the lens array and the target is changed so as to reduce any influence to the change in the image plane distance with a dimensional change of the lens array, and thereby deterioration in the optical performance can be suppressed.

DETAILED DESCRIPTION OF EMBODIMENTS

Figure 1:
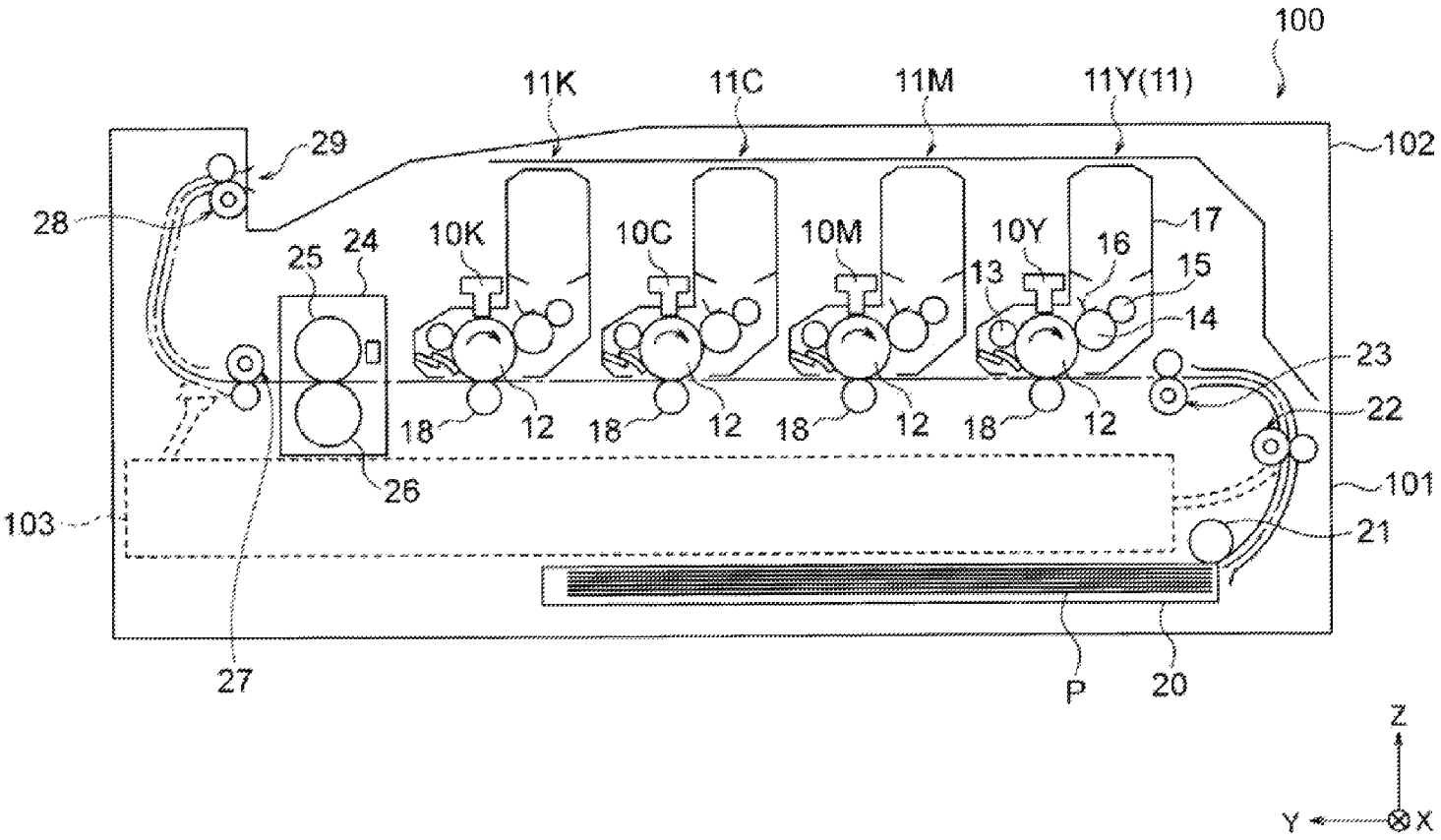
FIG. 1 is a diagram illustrating a basic configuration of a printer that uses an optical head according to a first embodiment of the invention as an optical print head.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment

<Configuration of the Image Formation Apparatus>

FIG. 1 is a diagram illustrating a basic configuration of printer 100 serving as an image formation apparatus that uses an optical head according to a first embodiment of the invention as an optical print head. Printer 100 is herein a printer that forms a color image using a method of electrophotography, however, printer 100 may be a printer that forms a monochrome image.

As illustrated in FIG. 1, printer 100 is provided with process units (image formation units) 11Y, 11M, 11C, and 11K that respectively form images of yellow (Y), magenta (M), cyan (C), and black (K) colors. Process units 11Y, 11M, 11C, and 11K are arranged along a conveyance path of recording medium P from the upstream side towards the downstream side (herein from the right side to the left side), in lower case 101 configuring a housing of printer 100. As for recording media P, in addition to printing paper, OHP sheets, envelopes, copying paper, specialty paper, and the like can be used.

At the upper sides of process units 11Y, 11M, 11C, and 11K, optical print heads 10Y, 10M, 100, and 10K (exposure devices) serving as optical heads are disposed so as to be respectively opposed to photosensitive drums 12 (which are described later). Optical print heads 10Y, 10M, 100, and 10K expose surfaces of photosensitive drums 12 in accordance with image data of the respective colors to form electrostatic latent images.

Printer 100 is provided with media cassette 20 and hopping roller 21 in a lower portion thereof. Media cassette 20 serving as a media storage unit stores therein recording media P, and hopping roller 21 sends out recording media P that is stored in media cassette 20 one by one to the conveyance path. A pair of register rollers 22 and a pair of conveyance rollers 23 are disposed along the conveyance path of recording medium P that is sent out from media cassette 20. The pair of register rollers 22 conveys recording medium P while correcting the skew. The pair of conveyance rollers 23 conveys recording medium P thus conveyed to process units 11Y, 11M, 11C, and 11K.

Process units 11Y, 11M, 11C, and 11K have a common configuration except for the toner to be used, and thus, are described hereinafter as "process unit 11". Moreover, optical print heads 10Y, 10M, 100, and 10K are described as "optical print head 10".

Process unit 11 is provided with photosensitive drum 12 serving as an electrostatic latent image carrier, charge roller 13 serving as a charge member, development roller 14 serving as a developer carrier, supply roller 15 serving as a developer supply member, development blade 16 serving as a developer regulation member, and toner cartridge 17 serving as a developer storage body.

Photosensitive drum 12 is formed in such a manner that photoconductive layers (an electric charge generation layer and a charge transport layer) are stacked on a surface of a cylindrical member made of metal. Photosensitive drum 12 rotates in a clockwise direction in FIG. 1 by a driving mechanism, which is not illustrated, including a driving source and a gear train.

Charge roller 13 is a roller with a semiconducting elastic layer provided on a surface of a metal shaft. Charge roller 13 is applied with a charge voltage to equally charge a surface of photosensitive drum 12. Development roller 14 is a roller with a semiconducting elastic layer provided on a surface of a metal shaft. Development roller 14 is applied with a development voltage, and causes toner (developer) to be adhered on an electrostatic latent image formed on the surface of photosensitive drum 12 to develop the electrostatic latent image, thereby forming a toner image (developer image).

Supply roller 15 is a roller with a semiconducting elastic layer provided on a surface of a metal shaft. Supply roller 15 is applied with a supply voltage, and supplies toner resupplied from toner cartridge 17 to development roller 14. Development blade 16 is formed in such a manner that an elongated-shaped plate member made of metal is bent so to cause the bent portion to press against a surface of development roller 14. Development blade 16 regulates the thickness of a toner layer on the surface of development roller 14.

Toner cartridge 17 is removably attached to process unit 11, and stores toner therein. Toner cartridge 17 resupplies toner to development roller 14 and supply roller 15.

Transfer roller 18 serving as a transfer member is disposed at the lower side of each process unit 11 so as to be opposed to photosensitive drum 12. Transfer roller 18 is a roller with a semiconducting elastic layer (rubber or the like) provided on a surface of a metal shaft. Transfer roller 18 is applied with a transfer voltage, and transfers the toner image on the surface of photosensitive drum 12 onto recording medium P that passes through between photosensitive drum 12 and transfer roller 18.

Fixation unit 24 is disposed at the downstream side (the left side in FIG. 1) of process units 11Y, 11M, 11C, and 11K in the conveyance direction of recording medium P. Fixation unit 24 is provided with fixation roller 25 and pressurization roller 26 that fix the toner image transferred onto recording medium P to recording medium P by heat and pressure.

Moreover, pairs of discharge rollers 27, 28 for discharging recording medium P, the fixation of which is completed, to the outside of printer 100 are provided at the downstream side of fixation unit 24 in the conveyance direction of recording medium P. Moreover, stacker 29 that places discharged recording medium P thereon is provided on upper cover 102 of printer 100.

Note that, printer 100 is provided with duplex printing unit 103 (illustrated by a dashed line in FIG. 1). Duplex printing unit 103 conveys recording medium P with a surface onto which the toner image is completed to be transferred and fixed, while inverting both sides of recording medium P to a pair of register rollers 22 in a duplex printing mode. An explanation of duplex printing unit 103 is omitted.

In the foregoing configuration, an axis direction of photosensitive drum 12 is set as an X direction. Moreover, a movement direction of recording medium P when being passed by process units 11Y, 11M, 11C, and 11K is set as a Y direction. Moreover, a direction orthogonal to both of the X direction and the Y direction is set as a Z direction. Herein, the Z direction is set as the vertical direction. Optical print head 10 is positioned in a +Z direction (upward) of photosensitive drum 12.

<Basic Operation of the Image Formation Apparatus>

Next, a basic operation of printer 100 is described. Upon reception of a printing command and printing data from a higher-level apparatus such as a personal computer, printer 100 executes an image formation operation. Hopping roller 21 firstly rotates, and sends out recording media P that is stored in media cassette 20 one by one to the conveyance path. A pair of register rollers 22 and a pair of conveyance rollers 23 convey recording medium P that is sent out in the conveyance path to process units 11Y, 11M, 11C, and 11K.

In each process unit 11, charge roller 13 equally charges the surface of photosensitive drum 12. Optical print head 10 thereafter exposes the surface of photosensitive drum 12 with light to form an electrostatic latent image. Moreover, supply roller 15 supplies toner that is supplied from toner cartridge 17 to development roller 14 to allow development blade 16 to form a toner image of a uniform thickness on the surface of development roller 14. Development roller 14 develops the electrostatic latent image formed on the surface of photosensitive drum 12 to obtain a toner image. The toner image formed on the surface of photosensitive drum 12 is transferred onto recording medium P that passes through between photosensitive drum 12 and transfer roller 18. Recording medium P passes process units 11Y, 11M, 11C, and 11K to allow toner images of yellow, magenta, cyan and black colors to be transferred onto the surface of recording medium P.

Recording medium P onto which the toner images are transferred is conveyed to fixation unit 24, and is applied with heat and pressure by fixation roller 25 and pressurization roller 26 to allow the toner images to be fixed on recording medium P. Recording medium P to which the toner images are fixed is discharged by pairs of discharge rollers 27, 28 to the outside of printer 100, and is placed on stacker 29. This completes the image formation operation.

<Configuration of the Optical Printing Head>

Figure 2:
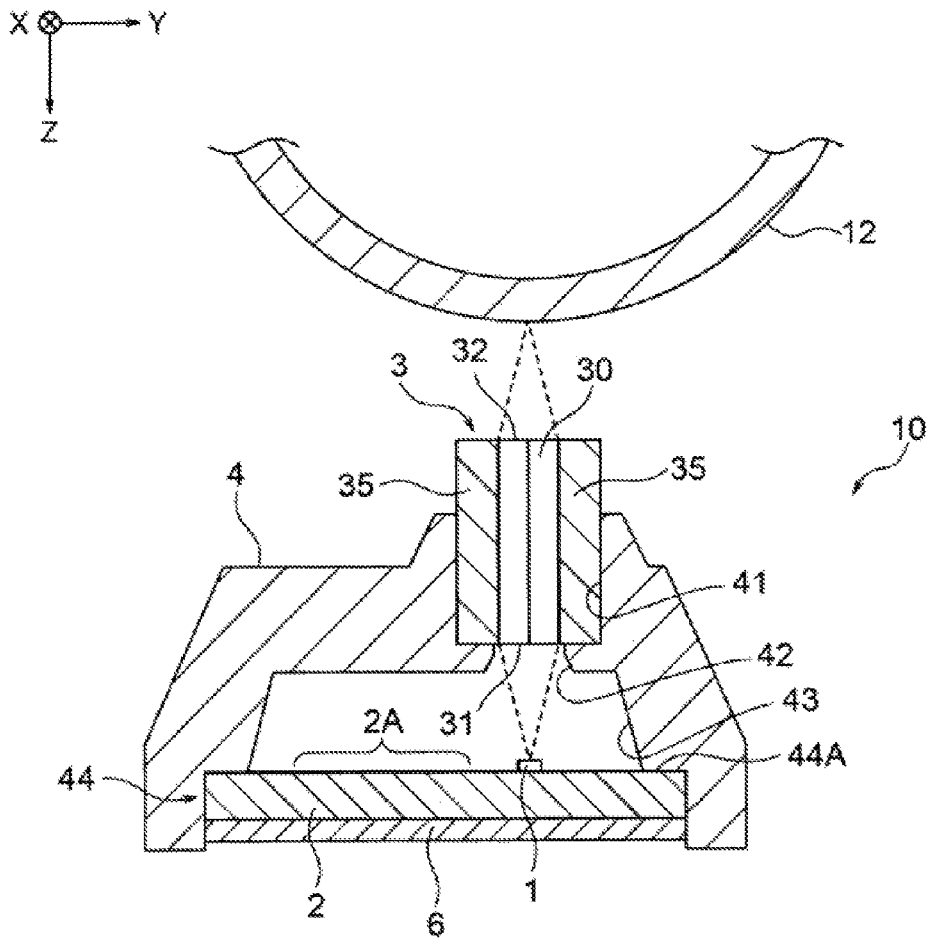
FIG. 2 is a schematic diagram illustrating a positional relation between the optical print head and a photosensitive drum in the first embodiment.
Figure 3:
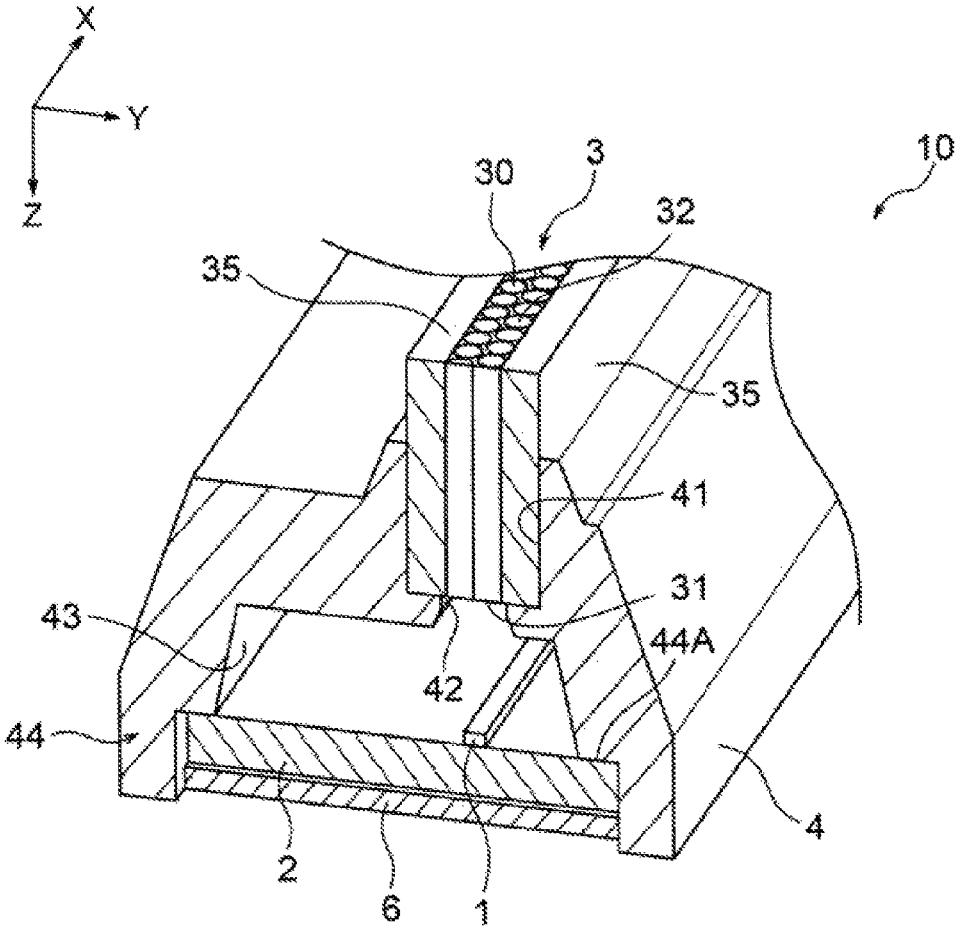
FIG. 3 is an enlarged perspective diagram illustrating the optical print head in the first embodiment.
Figure 4:
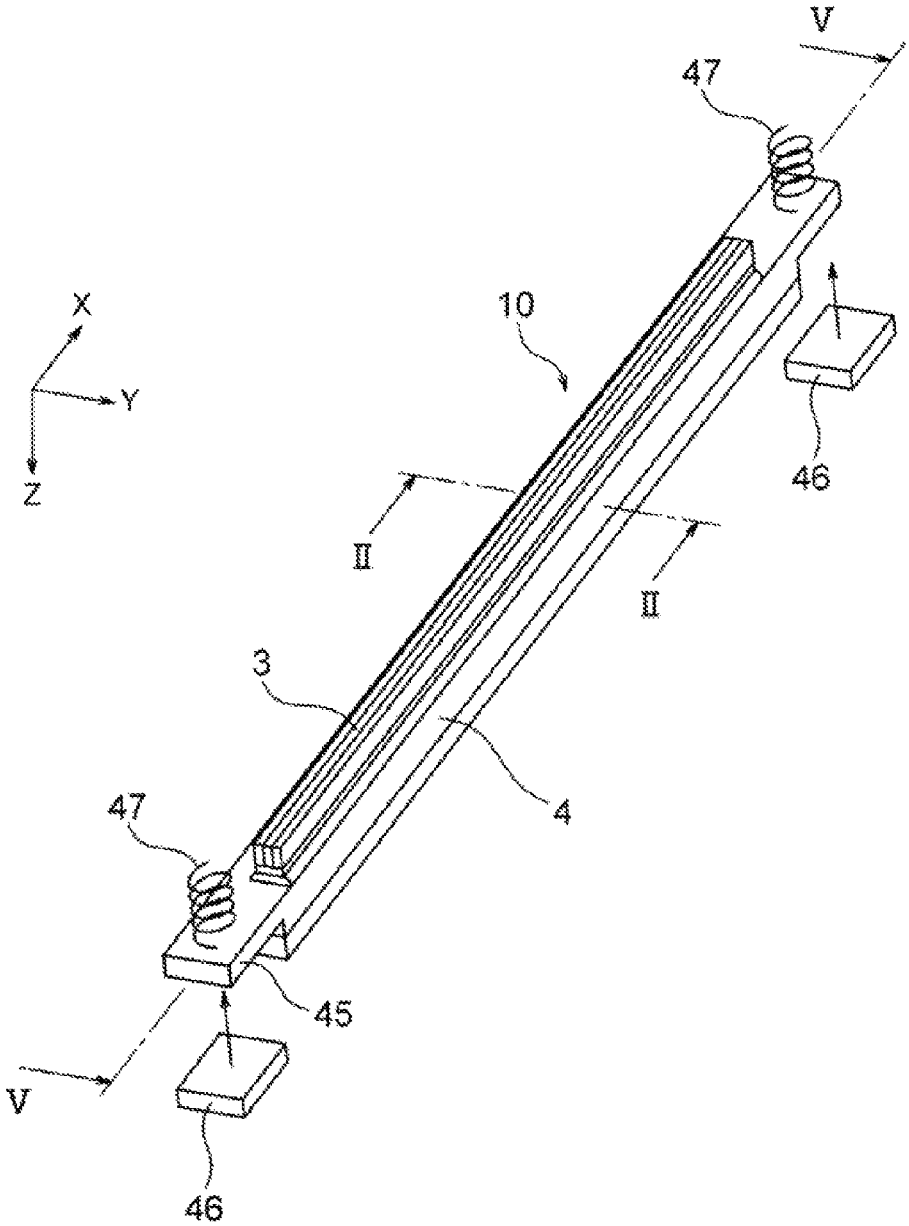
FIG. 4 is a perspective diagram illustrating an appearance shape of the optical print head in the first embodiment.

Next, a configuration of optical print head 10 serving as an optical head in the first embodiment is described. FIG. 2 is a diagram schematically illustrating a positional relation between optical print head 10 and photosensitive drum 12. FIG. 3 is an enlarged perspective diagram illustrating optical print head 10, and illustrating a portion thereof as a cross section. FIG. 4 is a perspective diagram illustrating an appearance shape of optical print head 10. Note that, each of the cross sections in FIG. 2 and FIG. 3 corresponds to a cross section taken along line II-II illustrated in FIG. 4.

As illustrated in FIG. 2, optical print head 10 is incorporated into printer 100 so as to keep a constant distance to the surface of photosensitive drum 12. Optical print head 10 is provided with light-emission element array 1, substrate 2 on which light-emission element array 1 is mounted, rod lens array 3 serving as a lens array, and holder 4 that holds these components.

As illustrated in FIGS. 2 and 3, light-emission element array 1 is formed in such a manner that multiple light-emission elements including light-emitting diodes (LEDs), for example, are arranged in the X direction (main-scanning direction) that is the axis direction of photosensitive drum 12. Each light-emission element in light-emission element array 1 is controlled by drive circuit 2A, which is described next, and emits light towards photosensitive drum 12.

Substrate 2 is mounted with light-emission element array 1 on a surface thereof, and is mounted with drive circuit 2A for driving each light-emission element in light-emission element array 1 thereon. Drive circuit 2A is electrically connected to each of the LEDs in light-emission element array 1 with a metal wire and the like. Substrate 2 is made of, for example, a glass epoxy resin.

Rod lens array 3 includes multiple rod lenses (lens elements) 30 that form an image with light emitted from the light-emission elements in light-emission element array 1 on the surface of photosensitive drum 12. Rod lenses 30 are arranged in a single row or in a plurality of rows (herein, two rows) in the X direction that is the main-scanning direction.

Each rod lens 30 constituting rod lens array 3 is an approximately cylindrical lens with its axis direction being in the Z direction. Each rod lens 30 includes light-incident surface that is opposed to light-emission element array 1, and light-exit surface 32 that is opposed to photosensitive drum 12. Rod lens 30 is made of, for example, an acrylic resin having a high degree of transparency and a comparatively high weather resistance.

The dashed line in FIG. 2 indicates an optical path from one light-emission element in light-emission element array 1 to the surface of photosensitive drum 12. Rod lens 30 generally has an angular aperture of about 10 degrees to 20 degrees (half angle) . Light emitted from the light-emission element of light-emission element array 1 to the outsides of the angular aperture of rod lens 30 is not captured by rod lens 30. A relation between an image and rod lens 30 is similar. Accordingly, such a configuration herein employed produces an image that is formed on the surface of photosensitive drum 12 with light that is emitted from one light-emission element and is received by imaging effects of a plurality of pieces (herein, several pieces) of rod lenses 30 constituting rod lens array 3.

A radial type gradient index lens having a refractive index distribution in a lens radial direction is used as rod lens 30. The use of the radial type gradient index lens allows light that enters light-incident surface 31 of rod lens 30 in a direction slanted with respect to the optical axis direction to be emitted from light-exit surface 32 without being diverged, and an image is thereby formed with the light. This prevents light emitted from each light-emission element in light-emission element array 1 from being diffused in the main-scanning direction. A material having a low transmittance is filled in between adjacent rod lenses 30.

Rod lenses 30 are herein arranged in two rows, and are held by being sandwiched by a pair of substrates 35 from both sides in the Y direction. Substrate 35 is an approximately rectangular plate member having a height (dimension in the Z direction) the same as the length in the optical axis direction of rod lenses 30, and is made of, for example, a phenol resin.

Holder 4 is made of, for example, structural steel or a structural resin. Recess part 41 that receives rod lens array 3 is formed at a side (the −Z side) of holder 4 that is opposed to photosensitive drum 12. Rod lens array 3 is stored in recess part 41 in a state where the side of light-exit surfaces 32 in rod lens array 3 is protruded towards the side of photosensitive drum 12. Opening 42 is formed in the bottom of recess part 41 at a position corresponding to light-incident surfaces 31 in rod lens array 3.

Space part 43 that receives substrate 2 is formed at the side (the +Z side) of holder 4 opposite to photosensitive drum 12. Space part 43 is communicated with recess part 41 via opening 42. In space part 43, step parts 44 to which substrate 2 is attached are formed at both sides in the Y direction of substrate 2.

Substrate 2 is fixed to step parts 44 in space part 43 of holder 4. A surface of substrate 2 on the photosensitive drum 12 side (the −Z side) is in contact with substrate contact surfaces 44A of step parts 44, so that light-emission element array 1 on substrate 2 is positioned in the Z direction with respect to rod lens array 3. Moreover, a rear surface side (the +Z side) of substrate 2 is sealed with shield plate 6. Shield plate 6 is made of, for example, polycarbonate.

As illustrated in FIG. 4, a pair of planar protrusion parts 45 further protrudes in the X direction from both ends in the X direction (longitudinal direction) of holder 4. Urge member 47 such as a coil spring is attached to the photosensitive drum 12 side (the −Z side) of each protrusion part 45 Moreover, resin spacer 46 is attached to the opposite side (the +Z side) of each protrusion part 45 from the photosensitive drum 12 side.

Resin spacer 46 is made of a resin which is able to increase in dimensions due to moisture absorption (moisture is absorbed) and decrease in dimensions due to moisture dissipation. The resin is preferably nylon (polyamide), a cellulose resin, or an acrylic resin. In particular, the nylon is preferably nylon 66 (polyamide 66) or nylon 6 (polyamide 6). The cellulose resin is preferably acetylcellulose. The acrylic resin is preferably polymethylmethacrylate.

Note that, protrusion parts 45, resin spacers 46, and urge members 47 of holder 4 constitute a "positioning mechanism" that positions rod lens array 3 so as to be opposed to photosensitive drum 12 (a target or an imaging target).

Figure 5:
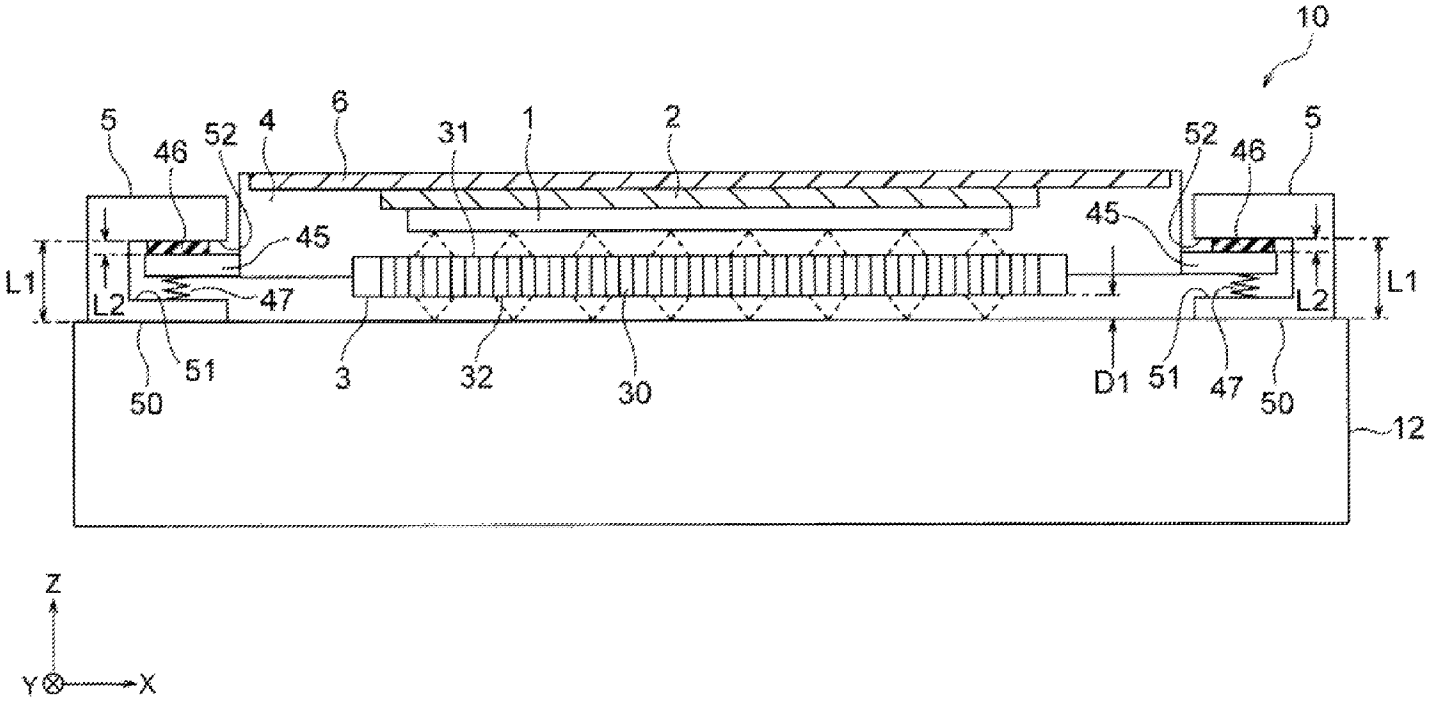
FIG. 5 is a vertical cross-sectional diagram illustrating the optical print head and the photosensitive drum in the first embodiment.

FIG. 5 is a vertical cross-sectional diagram illustrating optical print head 10 and photosensitive drum 12. The cross section in FIG. 5 corresponds to the cross section taken along line V-V illustrated in FIG. 4. As illustrated in FIG. 5, optical print head 10 is supported by head supports 5 serving as a pair of supports that are disposed at both ends in the axis direction of photosensitive drum 12. Head support 5 is made of, for example, polyacetal.

Each head support 5 includes contact surface 50 that slides with respect to the surface of photosensitive drum 12, and recess part 51 that is formed at a position with a predetermined distance in the Z direction from contact surface 50. Recess part 51 is opened to a side opposed to optical print head 10.

Protrusion part 45, resin spacer 46, and urge member 47 of holder 4, which are described above, are inserted into recess part 51 of head support 5. Urge member 47 urges protrusion part 45 of holder 4 toward resin spacer 46 (the +Z side). This causes resin spacer 46 to be pressed against inner surface 52 on the +Z side of recess part 51 (in other words, the opposite side of recess part 51 from photosensitive drum 12).

Figure 6:
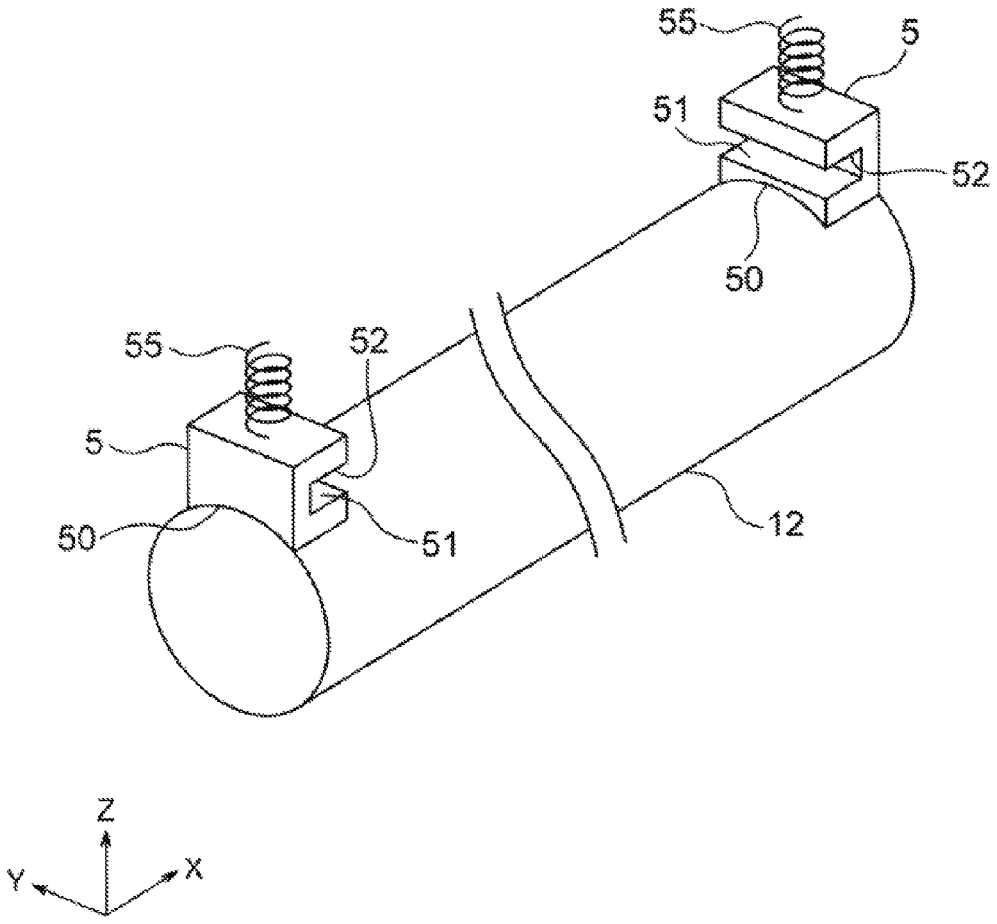
FIG. 6 is a schematic diagram illustrating head supports and the photosensitive drum in the first embodiment.

FIG. 6 is a schematic diagram illustrating head supports 5 and photosensitive drum 12. Contact surface 50 of each head support 5 is formed in a circular arc shape along the surface of photosensitive drum 12. Moreover, press member 55, such as a coil spring, is provided in contact with opposite surface (the +Z side surface) 54 of each head support 5 from contact surface 50. Press members 55 are attached to, for example, upper cover 102 (FIG. 1) of printer 100, and press head supports 5 against the surface of photosensitive drum 12.

With such a configuration, as illustrated in FIG. 5, distance D1 between optical print head 10 and the surface of photosensitive drum 12 is determined based on distance L1 from contact surface 50 of head support 5 to inner surface 52 of each recess part 51, and thickness L2 of each resin spacer 46. In other words, distance D1 is measured from light-exit surfaces 32 of rod lenses 30 in rod lens array 3 that is mounted on optical print head 10 to the surface of photosensitive drum 12 (imaging target) provided at the imaging position (focal position). Distance D1 is generally 2 mm to 20 mm.

In the embodiment, as described above, resin spacer 46 is made of a resin which is able to increase in dimensions due to moisture absorption and decrease in dimensions due to moisture dissipation. The reason of this is as follows.

Each rod lens 30 in rod lens array 3 is made of a resin (for example, acrylic resin). In general, the resin increases in dimensions due to moisture absorption (water absorption) and decreases in dimensions due to moisture dissipation. In particular, with the characteristics of radial type gradient index lenses that constitute rod lenses 30, the longer the dimension in the optical axis direction of each rod lens 30 is, the shorter an image plane distance is.

In general with radial type gradient index lenses, the decrease amount of the image plane distance is about five times larger than the increase amount of the length in the optical axis direction. Accordingly, when a radial type gradient index lens made of a resin is used, and an image plane distance is shortened due to the increased length of the lens in the optical axis direction by the moisture absorption, an image is formed with light that is emitted from each light-emission element in the light-emission element array at a point before the light reaches the photosensitive drum.

Therefore, in the embodiment, optical print head 10 is positioned with respect to photosensitive drum 12 via resin spacers 46. When the image plane distance is shortened due to the moisture absorption by rod lenses 30 that constitute rod lens array 3, resin spacers 46 increase in thickness L2 due to the moisture absorption by resin spacers 46.

As described in the foregoing, distance D1 from the light-exit surfaces of rod lenses 30 to the surface of photosensitive drum 12 is determined based on distance L1 from contact surface 50 of head support 5 to inner surface 52 of recess part 51 and thickness L2 of resin spacer 46. Meanwhile, distance L1 is constant because of no dimensional change of head support 5 that is made of a structural resin having extremely low moisture-absorption characteristics. Accordingly, the distance from the light-exit surfaces of rod lenses 30 to the surface of photosensitive drum 12 is changed depending on thickness L2 of resin spacers 46.

Figure 7:
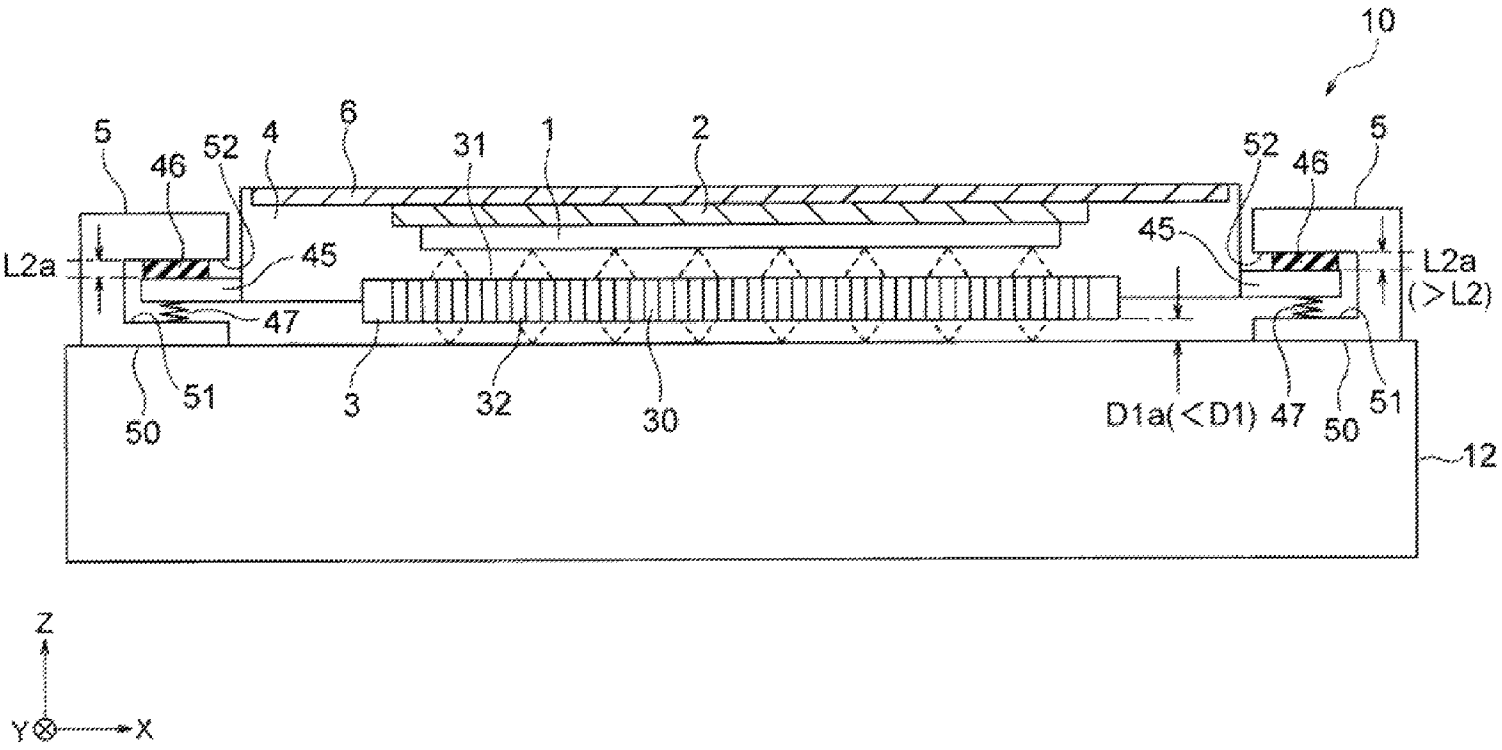
FIG. 7 is a vertical cross-sectional diagram illustrating the optical print head and the photosensitive drum in the first embodiment.

Accordingly, as illustrated in FIG. 7, when the thickness is increased to L2*a* (>L2) due to the moisture absorption by resin spacers 46, the entire optical print head 10 is moved to a direction approaching photosensitive drum 12 to shorten the distance from light-exit surfaces 32 of rod lenses 30 to the surface of photosensitive drum 12 to a distance D1*a* (<D1).

In other words, a short image plane distance due to the moisture absorption by rod lenses 30 also results in a short distance from light-exit surfaces 32 of rod lenses 30 to the surface of photosensitive drum 12 due to the moisture absorption by resin spacers 46. This allows an imaging position of light by rod lenses 30 to adjust to the surface of photosensitive drum 12.

As described in the foregoing, resin spacer 46 is made of a resin the dimensions of which are able to increase due to moisture absorption, and decrease due to moisture dissipation. Moreover, the resin included in resin spacers 46 is preferably a resin having a saturated water absorption rate higher than that of the resin (for example, acrylic resin) included in rod lenses 30.

In particular, the use of nylon (for example, nylon 66 or nylon 6) or a cellulose resin (for example, acetylcellulose) allows comparatively thin resin spacers 46 to implement the dimensional change necessary for compensating the change otherwise occurring in the image plane distance. Note that, the resin included in resin spacers 46 is not limited to these examples.

Moreover, in order to improve the speeds of the moisture absorption and the moisture dissipation by resin spacers 46, through-holes for ventilation may be formed at portions in contact with resin spacers 46, in holder 4 and head supports 5.

<Effect of the First Embodiment>

Printer 100 (image formation apparatus) and optical print head 10 are assembled, for example, under an environment at a temperature of 23° C. and at a relative humidity of 50% (which is referred to as an ordinary temperature and humidity environment) to optimize the distance between optical print head 10 and photosensitive drum 12 in this state. Note that, optimizing the distance between optical print head 10 and photosensitive drum 12 is to set the distance such as to minimize the size of an image formed on the surface of photosensitive drum 12 with light emitted from the light-emission elements in light-emission element array 1.

The printing quality of printer 100 is largely influenced under a high temperature and humidity environment (for example, at a temperature of 27° C. and a relative humidity of 80%). Under the high temperature and humidity environment, the dimensions in the optical axis direction and the refractive index distribution are changed due to the moisture absorption by rod lens array 3 to obtain an image plane distance shorter by about 10 μm than that in the ordinary temperature and humidity environment.

Figure 8:
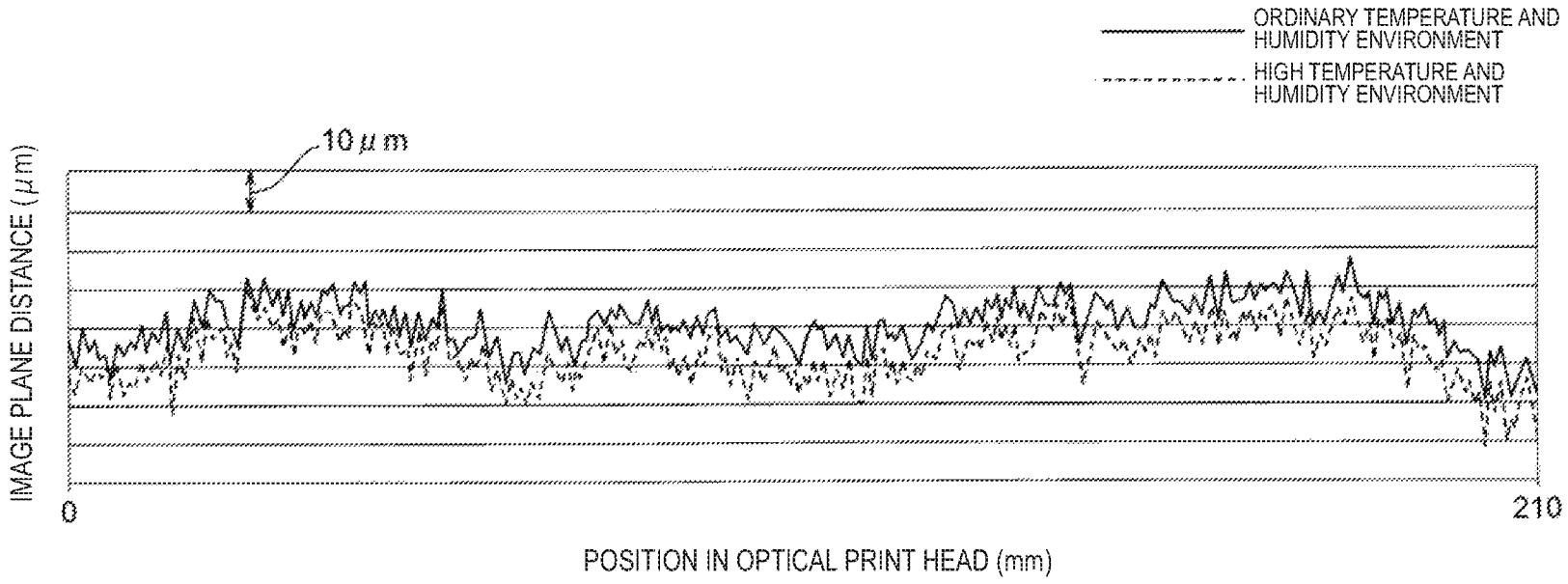
FIG. 8 is a graph illustrating changes in the image plane distance within a range of a length of the optical print head.

FIG. 8 is a graph illustrating a result of changes in image plane distance measured in optical print head 10 in which light-emission elements are arranged in a length (210 mm) corresponding to an A4 (recording media) size, within the range of the length. It is understood from FIG. 8 that in the entire region of the length (210 mm) corresponding to the A4 size, the image plane distance (dashed line) under the high temperature and humidity environment is shorter by about 10 μm than the image plane distance (solid line) under the ordinary temperature and humidity environment.

Figures 9A, 9B:
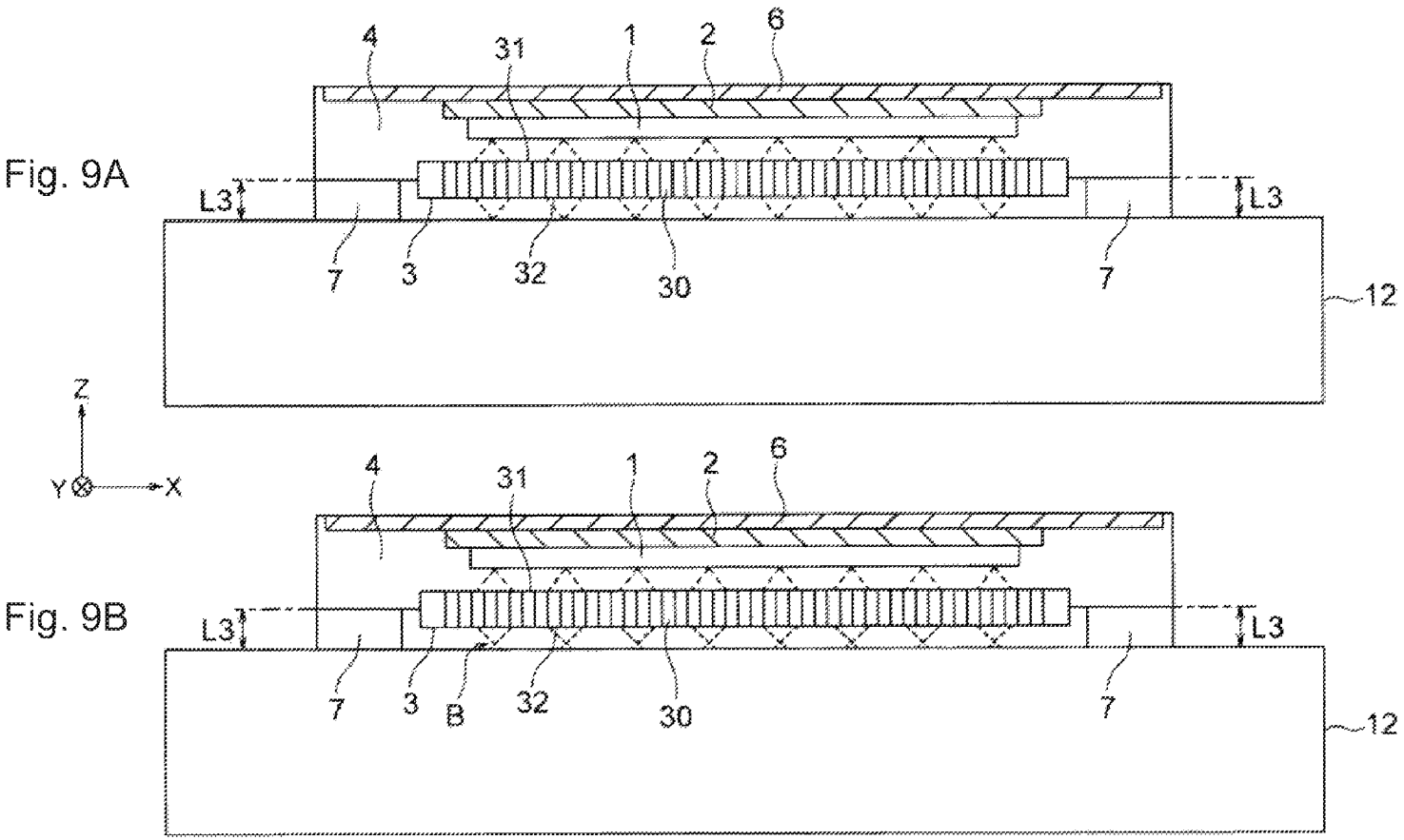
FIGS. 9A and 9B are diagrams illustrating an optical print head and a photosensitive drum in a comparative example.

FIGS. 9A and 9B illustrate a configuration example in which spacers 7, the dimensions of which are not changeable, are provided between optical print head 10 and photosensitive drum 12, as a comparative example with respect to the embodiment. In this case, a distance between optical print head 10 and photosensitive drum 12 is determined based on thickness L3 of spacers 7, and is constant independent of the environment conditions (temperature and humidity).

In such a configuration, an image plane distance that is shortened by about 10 μm due to the moisture absorption by rod lens array 3 results in an image to be formed with light from light-emission element array 1 at a point before the light reaches photosensitive drum 12, as indicated by arrow B in FIG. 9B. In other words, a larger image to be formed on the surface of photosensitive drum 12 with light from image light-emission element array 1 results in a so-called defocus state, thereby causing a deterioration in the printing quality.

In order to solve this problem, a technique of providing a correction lens can be considered, for example, as disclosed in Patent Literature 1 (Japanese Laid-open Patent Publication No. 2011-034673), however, the upsized and complicated configuration of the head prevents the technique from being actually applied to optical print head 10 of printer 100.

In contrast, in the embodiment, the position of optical print head 10 with respect to photosensitive drum 12 is determined using resin spacers 46 which are able to increase in dimensions due to moisture absorption and decrease in dimensions due to moisture dissipation. This can compensate for any shortening of an image plane distance due to the moisture absorption by rod lenses 30 so to allow an image to be formed with light on the surface of photosensitive drum 12, without the configuration of the head increase in size and becoming complicated.

Examples of a material for resin spacer 46 include nylon 66. The saturated water absorption rate of the nylon 66 is generally several percent to ten percent. Moreover, the dimensional variation due to the moisture absorption is generally a fraction of the water absorption rate. Moreover, the saturated water absorption rate of the acrylic resin included in rod lens array 3 is approximately 0.1 to 1%.

Figure 10:
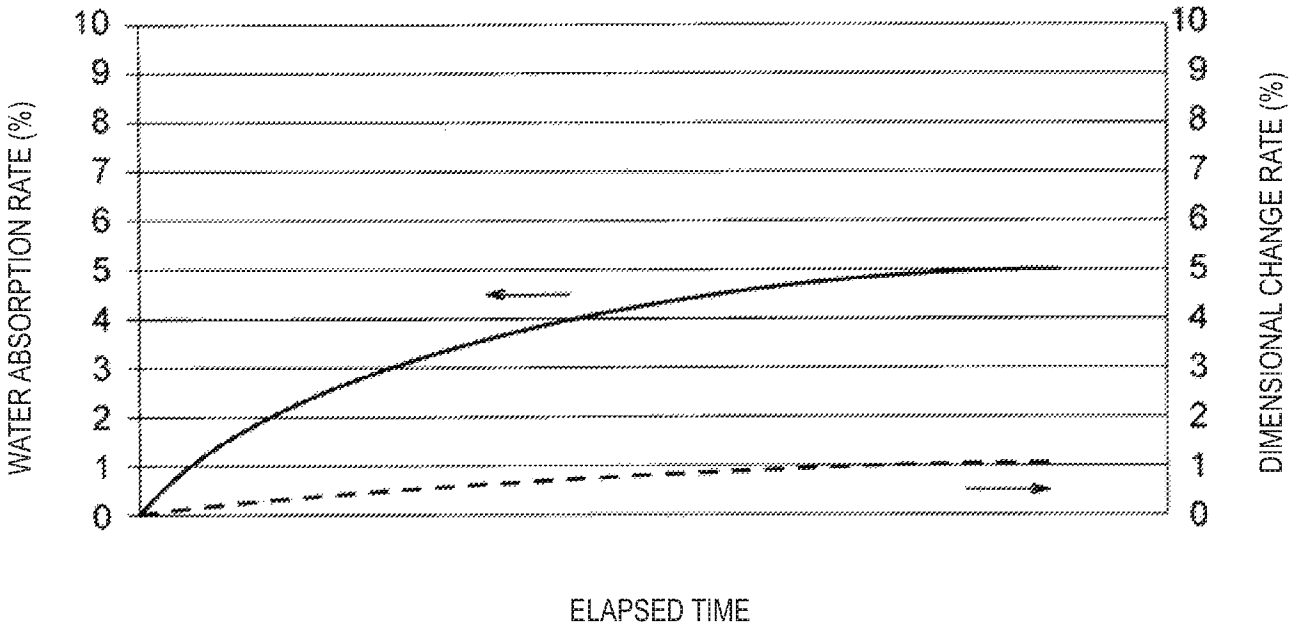
FIG. 10 is a graph illustrating an example of measurement results of time-dependent changes in the water absorption rate and the dimensional change of a resin spacer.

FIG. 10 illustrates measurement results of time-dependent changes in the water absorption rate and the dimensional change of resin spacer 46 made of the nylon 66. It is understood from FIG. 10 that a curve indicating the water absorption rate of resin spacer 46 made of the nylon 66 levels off at approximately 5%, and the water absorption rate is saturated at approximately 5%. Moreover, the dimensional change rate corresponding to the water absorption rate (saturated water absorption rate) is approximately 1%.

Accordingly, when thickness L2 of resin spacer 46 is 1 mm, the change amount due to the moisture absorption under the high temperature and humidity environment is 10 μm (=1 mm×1/100). In other words, the distance between optical print head 10 and photosensitive drum 12 is shortened by about 10 μm. Accordingly, optical print head 10 is made closer to photosensitive drum 12 (in other words, the distance between rod lens array 3 and photosensitive drum 12 is shortened), which can compensate for about 10 μm by which the image plane distance is shortened due to the moisture absorption by rod lens array 3 from the distance under the ordinary temperature and humidity environment.

Note that, a variation in image plane distance of rod lens array 3 occurs per unit of time from one day to several days, for example. Resin spacer 46 preferably has a volume as small as possible and a surface area as large as possible in order to cause the dimensional change (see FIG. 10) of resin spacers 46 to rapidly cope with the variation in the image plane distance of rod lens array 3. Accordingly, for example, as illustrated in FIG. 4, a thin-plate shape having a large surface area is preferable.

Moreover, when the dimensional change in resin spacers 46 occurs during a period of several days to several weeks depending on the material, the shape, and the volume, the functional effects can be achieved in an optical print head mounted on an image formation apparatus that is installed indoors where the temperature and the humidity are moderately changed through the year, for example.

As described in the foregoing, in the embodiment, holder 4 that holds rod lens array 3 is positioned with a distance to photosensitive drum 12 as an imaging target that is changed depending on the environment condition (at least either one of the temperature and the humidity). Thus, it is possible to prevent deterioration in the optical performance (defocus) by changing the distance between rod lens array 3 and photosensitive drum 12 so as to reduce an influence of change in the image plane distance due to a change in the environment condition. This can reduce the deterioration in printing quality in printer 100 that uses optical print head 10.

In particular, holder 4 is positioned via resin spacers 46, the dimensions of which are changeable due to moisture absorption, so that an effect of preventing deterioration in the optical performance can be produced with a simple apparatus configuration.

Moreover, holder 4 that holds rod lens array 3 is held by being pressed against resin spacers 46 by urge members 47. With this simple configuration, a dimensional change of resin spacers 46 can be translated into a change in distance between rod lens array 3 and photosensitive drum 12.

Moreover, protrusion parts 45 at both ends of holder 4 are respectively held by being pressed against resin spacers 46 by urge members 47, so that an imaging position of light can be corresponded to the surface of photosensitive drum 12 while rod lens array 3 and imaging target (photosensitive drum 12) are kept in parallel with each other.

Moreover, a resin (for example, nylon, a cellulose resin, an acrylic resin, or the like) which is able to increase in dimensions due to moisture absorption and decrease in dimensions due to moisture dissipation is used as resin spacers 46 to allow the dimensional change of resin spacers 46 that can compensate for the dimensional change of rod lens array 3 to be generated with high efficiency.

Note that, in the abovementioned explanation, the dimensional change of resin spacers 46 is used; however, the component is not limited to resin spacer 46. Any component that can change the distance between rod lens array 3 and an imaging target depending on the environment condition (at least either one of the temperature and the humidity) may be used.

Moreover, in the above-described explanation, an example in which rod lenses 30 use radial type refractive index distribution is described; however, the embodiment can be applied to a case where rod lenses having no radial type refractive index distribution are used. Moreover, the embodiment can be also applied to a case where a lens array having lens elements other than the rod lenses is used.

Moreover, in the above-described explanation, a positioning mechanism (such as resin spacers 46) that positions rod lens array 3 with respect to photosensitive drum 12 is provided to optical print head 10; however, an independent mechanism that is different from optical print head 10 may be provided.

<Image Reader>

Figure 11:
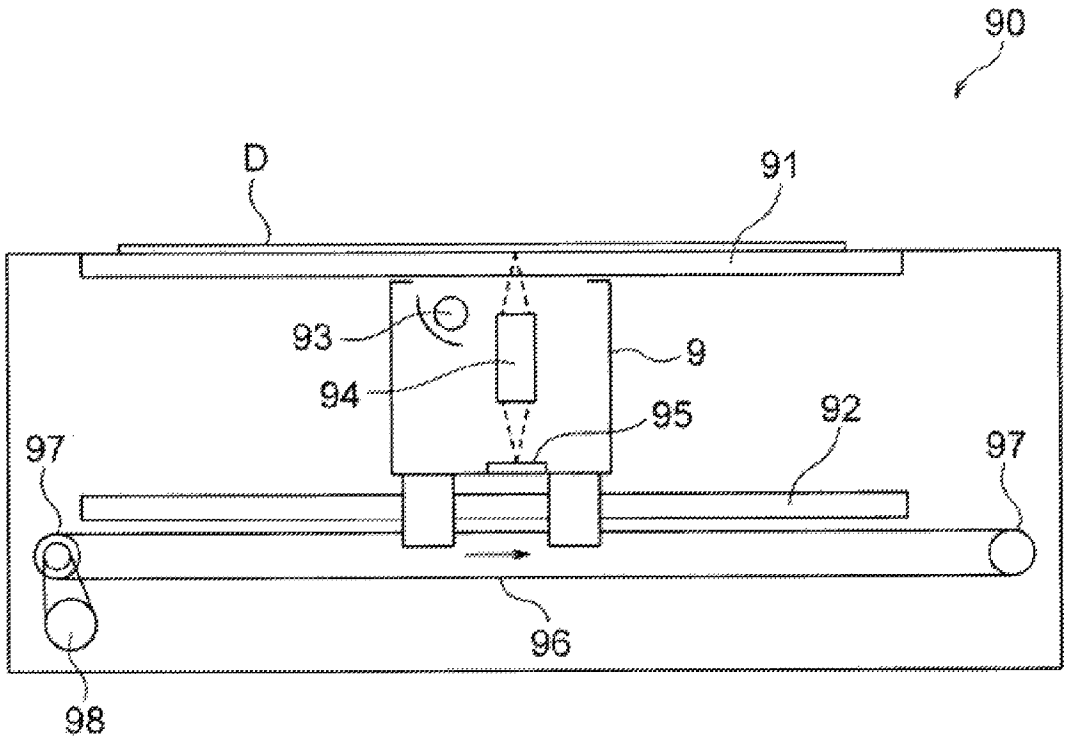
FIG. 11 is a diagram illustrating a configuration example of a scanner in which the optical head in the first embodiment is used as a reader head.

Next, a configuration example of scanner 90 as an image reader in which the optical head described in the embodiment is used as a reader head 9. FIG. 11 is a schematic diagram illustrating a configuration example of scanner 90.

Scanner 90 includes platen 91 on which document D serving as a reading target is placed. Platen 91 is made of a material such as a glass that allows a visible light beam to pass there-through. Reader head 9 serving as an optical head, and rail 92 that guides reader head 9 so as to be movable in parallel with platen 91, are disposed at a lower side of platen 91.

Reader head 9 includes light source 93 that illuminates document D with light, rod lens array 94 that gathers light reflected on a surface of document D, and image sensor 95 that is disposed at a light-concentrating position of the light by rod lens array 94. Rod lens array 94 includes multiple rod lenses that are arranged in a direction orthogonal to an extend direction of rail 92. Image sensor 95 is a line sensor in which multiple light receiving elements are arranged in parallel with an arrangement direction of the rod lenses.

Moreover, reader head 9 is connected to drive belt 96 extended between multiple pulleys 97. Drive belt 96 moves by the rotation of motor 98, and moves along rail 92 (along the lower surface of platen 91).

A basic operation of scanner 90 is as follows. When light source 93 lights up, light beams are reflected on document D, and captured inside reader head 9. Reader head 9 moves in parallel with the surface of document D with drive belt 96 that is driven by motor 98, and captures the light reflected on the surface of document D. The rod lenses in rod lens array 94 form an image with the light from document D to image sensor 95. Image sensor 95 converts a light signal of the received light into an electric signal.

Also in scanner 90, reader head 9 can be positioned with respect to platen 91 by the positioning mechanism including resin spacers 46 described with reference to FIG. 5. Specifically, a configuration in which platen 91 is disposed at the position of photosensitive drum 12 illustrated in FIG. 5 is employed. In this case, an imaging target or an imaging position (focal position) of the lens array is an upper surface (surface of document D) of platen 91. This configuration can reduce an influence of a change in image plane distance due to the moisture absorption by rod lens array 94, and prevent defocusing on the surface of document D.

Note that, instead of moving reader head 9 as described above, document D is conveyed by an automatic document feeder (ADF) so as to pass through a predetermined reading position on platen 91, and reader head 9 may read an image of document D that is stopped at the reading position.

The invention can be applied to an optical head such as an optical print head or a reader head, an image formation apparatus that uses the optical print head, an image reader that uses the reader head, and the like. Moreover, examples of the image formation apparatus include, for example, a printer, a copier, a facsimile device, a multifunction peripheral, and the like. Examples of the image reader include, for example, a scanner, a multifunction peripheral, and the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An optical head comprising:

a lens array that includes lenses made of a resin;

a holder that holds the lens array;

a positioning mechanism that positions the holder such that the holder is opposed to a target, wherein the positioning mechanism changes a distance between the lens array and the target depending on a change in at least any one of temperature and humidity, wherein the positioning mechanism includes a spacer made of a resin and having a dimension which is changeable due to moisture absorption; and an urge member that presses the holder against the spacer.

2. The optical head according to claim 1, wherein the urge member urges the holder in a direction apart from the target.

3. The optical head according to claim 1, wherein the holder comprises an elongated shape extending in an arrangement direction of the lenses in the holder, and the spacer and the urge member are provided at each of both longitudinal ends of the holder.

4. The optical head according to claim 3, wherein the holder includes protrusion parts at both longitudinal ends of the holder, the urge member is disposed on a side of the target with respect to each protrusion part, and the spacer is disposed on an opposite side from the target with respect to each protrusion part.

5. The optical head according to claim 4, further comprising a pair of supports in contact with a surface of the target, each of the supports including a recess part that receives the protrusion part, the urge member, and the spacer.

6. The optical head according to claim 1, wherein the dimension of the spacer is increased due to moisture absorption of the resin, and is decreased due to moisture dissipation of the resin.

7. The optical head according to claim 1, wherein the resin of the spacer is nylon.

8. The optical head according to claim 7, wherein the nylon is nylon 6 or nylon 66.

9. The optical head according to claim 1, wherein the resin of the spacer is a cellulose resin.

10. The optical head according to claim 9, wherein the cellulose resin is acetylcellulose.

11. The optical head according to claim 1, wherein the resin of the spacer is an acrylic resin.

12. The optical head according to claim 11, wherein the acrylic resin is a polymethylmethacrylate resin.

13. The optical head according to claim 1, wherein each of the lenses is a rod lens.

14. The optical head according to claim 1, further comprising a light-emission element array that is held by the holder, and is opposed to the lens array.

15. An optical print head comprising the optical head according to claim 1.

16. An image formation apparatus comprising:

an image carrier whose surface serves as the target;

an optical print head that includes the optical head according to claim 1, and exposes the image carrier to light to form a latent image;

a development unit that supplies a developer to the latent image formed on the image carrier, and develops the latent image to form a developer image;

a transfer unit that transfers the developer image on the image carrier onto a medium; and a fixation unit that fixes the developer image transferred on the medium to the medium.

17. An image reader comprising:

a platen, serving as the target, on which to place a reading target; and a reader head that includes the optical head according to claim 1, and is disposed to be opposed to the platen.

* * * * *